US008590591B2

(12) United States Patent
Ingram

(10) Patent No.: US 8,590,591 B2
(45) Date of Patent: Nov. 26, 2013

(54) WEATHER QUEEN ROMAN SHADE ASSEMBLY

(75) Inventor: Carla J. Ingram, Sarona, WI (US)

(73) Assignee: Weather Queen Shades, LLC, Sarona, WI (US)

( * ) Notice: Subject to any disclaimer, the term of this patent is extended or adjusted under 35 U.S.C. 154(b) by 0 days.

(21) Appl. No.: 13/433,334

(22) Filed: Mar. 29, 2012

(65) Prior Publication Data

US 2013/0174989 A1 Jul. 11, 2013

Related U.S. Application Data

(60) Provisional application No. 61/516,141, filed on Mar. 30, 2011.

(51) Int. Cl.
*A47H 5/032* (2006.01)

(52) U.S. Cl.
USPC ..... 160/84.06

(58) Field of Classification Search
USPC ..... 160/84.06, 84.04, 84.01, 172 R, 330, 160/345
See application file for complete search history.

(56) References Cited

U.S. PATENT DOCUMENTS

| | | | | | |
|---|---|---|---|---|---|
| 3,777,800 | A * | 12/1973 | Susoev | 160/84.04 |
| 4,037,526 | A * | 7/1977 | Jaekle | 454/166 |
| 4,557,310 | A * | 12/1985 | Castellaw et al. | 160/84.06 |
| 4,741,375 | A * | 5/1988 | Milford et al. | 160/84.06 |
| 4,880,045 | A * | 11/1989 | Stahler | 160/84.04 |
| 4,934,435 | A * | 6/1990 | Regev | 160/84.04 |
| 5,111,866 | A * | 5/1992 | Prostko | 160/90 |
| 5,217,057 | A * | 6/1993 | Hubbard et al. | 160/345 |
| 5,275,221 | A * | 1/1994 | Doehlemann | 160/84.04 |
| 5,355,928 | A * | 10/1994 | Robertson | 160/84.04 |
| 6,715,531 | B2 * | 4/2004 | Simon | 160/271 |
| 7,631,682 | B2 * | 12/2009 | Lamers et al. | 160/84.06 |
| 2006/0243397 | A1 * | 11/2006 | Liang | 160/84.06 |

* cited by examiner

*Primary Examiner* — David Purol
(74) *Attorney, Agent, or Firm* — Tipton Randall

(57) ABSTRACT

A roman shade assembly providing an opaque covering for dwelling openings. The shade assembly includes a planar, flexible shade body with horizontal pleats and pockets extending between opposed edges. A head rail member installed atop a dwelling opening has pulleys and attaches to the upper end of the shade body. A pair of track members is mounted vertically on opposite sides of the dwelling opening. The shade body fits between the track members. Each shade body pocket includes a rigid rod member for horizontal rigidity. Wheeled clip members within each track member attach to the shade body, maintaining the shade body close to the track members. Draw strings attached to a lower end of the shade body pass through grommets in the shade body and through the head rail member pulleys. The draw strings extend interior the dwelling, providing raising or lowering of the shade body from within.

18 Claims, 10 Drawing Sheets

WEATHER QUEEN ROMAN SHADE ASSEMBLY

CROSS-REFERENCE TO RELATED APPLICATIONS, IF ANY

This application claims the benefit under 35 U.S.C. §119 (e) of provisional application Ser. No. 61/516,141, filed 30 Mar. 2011. Application Ser. No. 61/516,141 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to shades and, more particularly, to roman shades and, most particularly, to roman shades that can be installed on the exterior side of windows and doors.

2. Background Information

All homes contain doors and windows, and maintaining doors and windows is a constant chore. Doors and windows are quite frequently fitted with screens to provide ventilation and cooling. Due to the flow of air through them, screens routinely accumulate dirt, dust, pollen, debris, etc. that requires removal. In some instances, the doors and windows can allow sunshine to enter the home, resulting in heating of the interior of the dwelling, as well as causing glare to the eyes of the inhabitants. Thus, it is often necessary to put some opaque covering over the windows and/or doors of the dwelling. Awnings function for this purpose, but are often unsightly and expensive. Various shades are currently available that can overcome some of these problems. However, there is an unmet need for a shade that can be installed on the interior or exterior of a window or door to provide reduction in the sunlight entering the dwelling. Additionally, an exterior shade that can protect the door or window from dust, debris and rain or snow is much needed.

Applicant has invented a roman shade that can be installed on the interior or the exterior of a door or window, and provides both shade and prevents dust and debris from collecting on the door, window or screen covering for any or all of these dwelling openings.

SUMMARY OF THE INVENTION

The invention is directed to a roman shade assembly adapted for vertical movement to provide an opaque covering for a dwelling opening. The roman shade assembly comprises a planar shade body of flexible material including a top and bottom edge with a plurality of horizontal pleats and pockets extending between opposed side edges of the shade body. A head rail member adapted for installation at a top of a dwelling opening includes a plurality of pulleys and an attachment system for securing the top edge of the shade body to the head rail member. A pair of linear track members is adapted for mounting vertically on opposite sides of the dwelling opening. The shade body is sized to fit between the vertically mounted track members, and each pocket of the shade body includes a rigid rod member providing horizontal rigidity to the shade body. A plurality of wheeled clip members is movably maintained within each linear track member. Each wheeled clip member is attached to one side edge of the shade body by a clip portion for maintaining the shade body close to the track members. A plurality of draw strings each is attached to the bottom edge of the shade body and threaded through vertically aligned grommets in the shade body. The draw strings are threaded through the pulleys attached to the head rail member. The draw strings are adapted for extending interior the dwelling, thereby providing raising or lowering of the shade body from within the dwelling.

The shade body also includes a flap at the top that attaches to the top side of the head rail. Preferably, the attachment of the flap is achieved with hook and loop tape that can be separated to provide access to the area above the head rail.

The roman shade of the present invention provides a secure covering for windows and doors that cannot be displaced by wind or rain. The rigid metal rods prevent gusts of wind from displacing the shade body from close proximity to the exterior of the window or door, thereby maintaining a clean, fresh glass pane, screen or door of the dwelling. In addition, the roman shade of the present invention is fabricated from an opaque material to prevent sunlight from entering the dwelling when the roman shade is partially or completely deployed over the window or door opening.

In some cases it may be desirable to mount the roman shade assembly on the interior of the door or window. The roman shade assembly of the present invention is readily adapted to such locations and functions with equivalent efficiency in all situations.

DESCRIPTION OF THE EMBODIMENTS

Nomenclature

Figure 1:
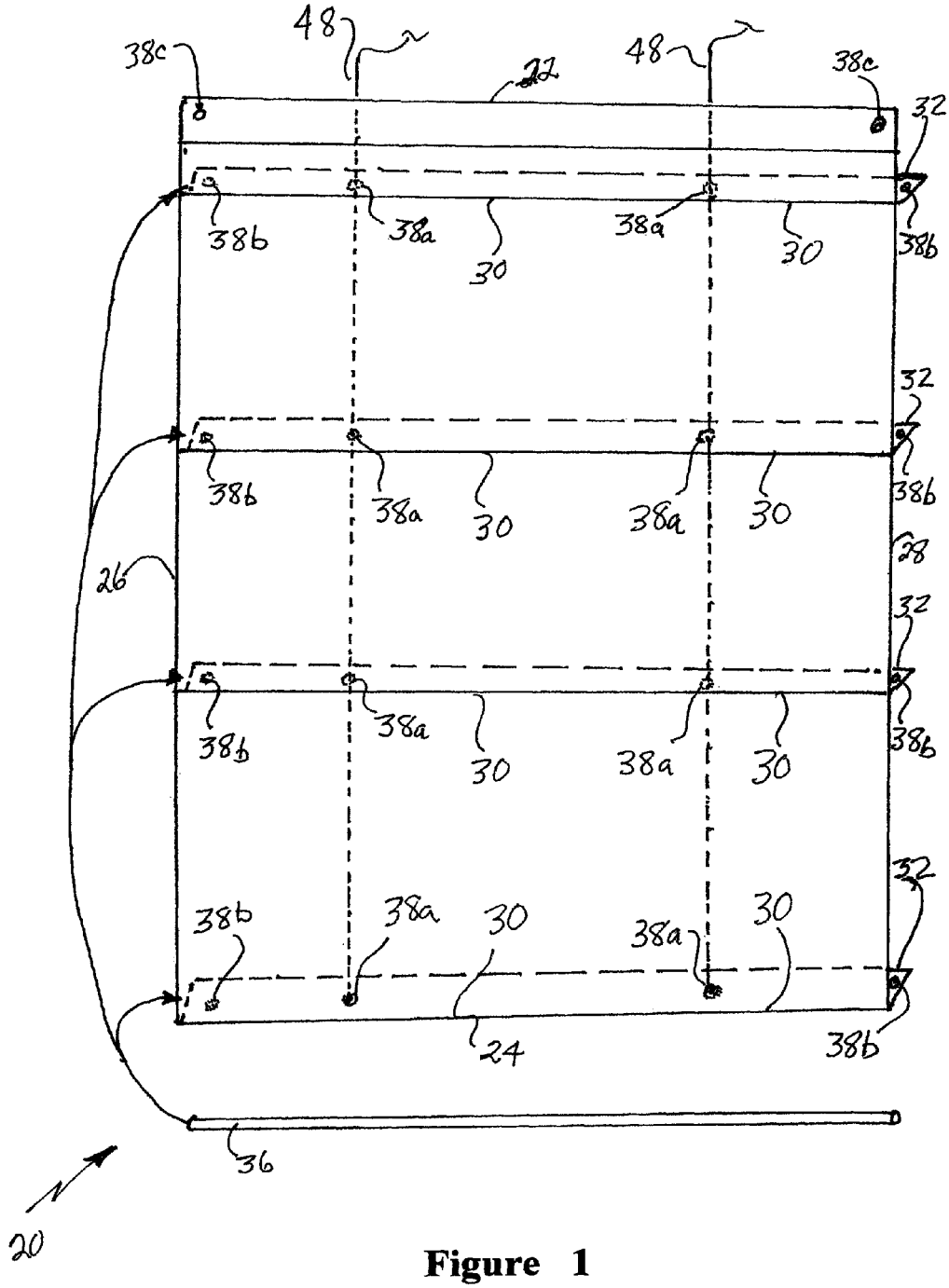
FIG. 1 is a front, perspective view of the shade body of the roman shade assembly of the present invention.

10 Shade Assembly
20 Shade Body

22 Top Edge of Shade Body
24 Bottom Edge of Shade Body
26 Side Edge of Shade Body
28 Side Edge of Shade Body
30 Horizontal Pleats
32 Pockets of Shade Body
36 Rigid Rod Members
38*a* Draw String Grommets
38*b* Attachment Grommets
38*c* Head Rail Grommets
40 Head Rail Member
42 Pulley Members
44 Attachment System
46 Hook and Loop Tape
48 Mounting Screws
50 Track Members
52 Hollow Interior of Track Member
53 Elevated Strip of Track Member
54 Access Slot of Track Member
56 First End of Track Member
58 Second End of Track Member
60 Exterior Mounting Flange Portion
70 Wheeled Clip Members
72 Wheeled Portion of Wheeled Clip Member
74 Clip Portion of Wheeled Clip Member
80 Draw String Members
84 Head Rail Mounting Brackets
86 Stops for Track Members
88 Through-the-Wall Pulley
90 Cleats for Draw Strings
92 Head Rail Cover

Construction

The invention is a roman shade assembly adapted for vertical movement to provide an opaque covering for a dwelling opening. The roman shade assembly comprises a planar shade body of flexible material including a top and bottom edge with a plurality of horizontal pleats and pockets extending between opposed side edges of the shade body. A head rail member adapted for installation at a top of a dwelling opening includes a plurality of pulleys and an attachment system for securing the top edge of the shade body to the head rail member. A pair of linear track members is adapted for mounting vertically on opposite sides of the dwelling opening. The shade body is sized to fit between the vertically mounted track members, and each pocket of the shade body includes a rigid rod member providing horizontal rigidity to the shade body. A plurality of wheeled clip members is movably maintained within each linear track member. Each wheeled clip member is attached to one side edge of the shade body by a clip portion for maintaining the shade body close to the track members. A plurality of draw strings each is attached to the bottom edge of the shade body and threaded through vertically aligned grommets in the shade body. The draw strings are threaded through the pulleys attached to the head rail member. The draw strings are adapted for extending interior the dwelling, thereby providing raising or lowering of the shade body from within the dwelling. The shade body also includes a flap at the top that attaches to the top side of the head rail. Preferably, the attachment of the flap is achieved with hook and loop tape that can be separated to provide access to the area above the head rail.

The roman shade of the present invention provides a secure covering for windows and doors that cannot be displaced by wind or rain. The rigid metal rods prevent gusts of wind from displacing the shade body from close proximity to the exterior of the window or door, thereby maintaining a clean, fresh glass pane, screen or door for the dwelling. In addition, the roman shade of the present invention is fabricated from an opaque material to prevent sunlight from entering the dwelling when the roman shade is partially or completely deployed over the window or door opening.

In some cases it may be desirable to mount the roman shade assembly on the interior of the door or window. The roman shade assembly of the present invention is readily adapted to such locations and functions with equivalent efficiency in all situations.

Figure 5:
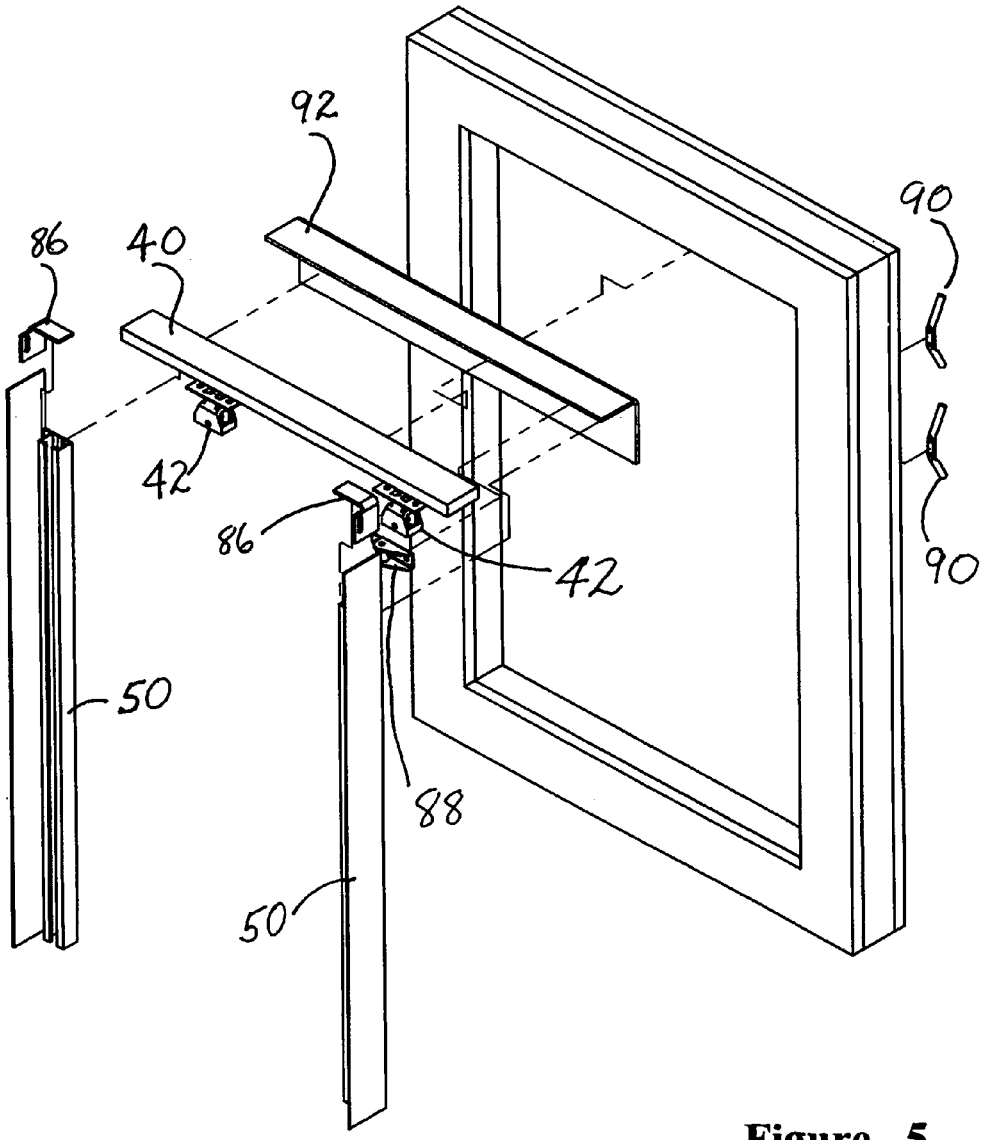
FIG. 5 is an exploded, perspective view of the head rail and track members of the roman shade assembly of the present invention fitted to the interior of a dwelling window.
Figure 6:
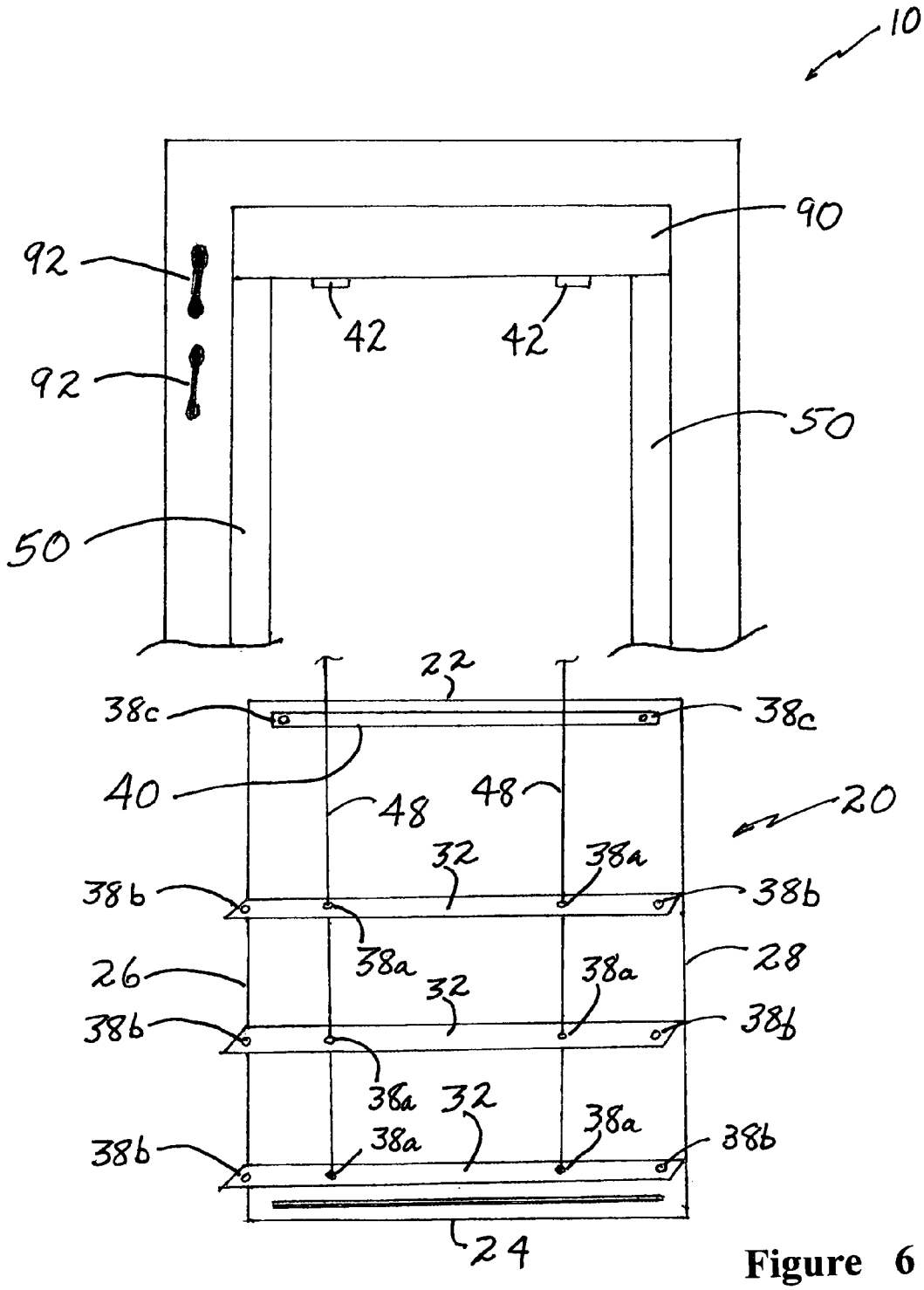
FIG. 6 is an interior view of the head rail, track members and shade body of the roman shade assembly of the present invention fitted to the interior of a dwelling window.

Referring now to FIGS. 1, 5 and 6, exploded views of the roman shade assembly 10 are shown. The roman shade assembly 10 of the present invention is adapted for vertical movement to provide an opaque covering for a dwelling opening. The roman shade assembly 10 comprises a planar shade body 20 of flexible material, such as canvas or other durable, flexible material. Preferably, the shade body 20 is fabricated from an exterior grade marine canvas or an exterior grade PVC Sheerweave shade fabric, both available from a number of commercial sources. The shade body 20 includes a top edge 22 and a bottom edge 24 and opposed side edges 26, 28, as illustrated in FIG. 1. The shade body 20 includes a plurality of horizontal pleats 30, each of which forms a pocket 32 that extends between opposed side edges 26, 28 of the shade body 20. All the pockets 32 are formed on one surface of the shade body 20, thus providing a smooth appearance for the opposite surface of the shade body 20. The shade body 20 also contains a plurality of grommets 38, the purpose of which is described later below.

A head rail member 40 is adapted for installation at a top of a dwelling opening for mounting the roman shade assembly 10. The head rail member 40 includes a plurality of pulley members 42 and an attachment system 44 for securing the top edge 22 of the shade body 20 to the head rail member 40. Preferably, the attachment system 44 comprises lengths of hook and loop tape strip 46, with one tape strip 46 fastened to the top edge 22 of the shade body 20 and another, complementary, tape strip 46 fastened to the head rail member 40. Thus, the head rail member 40 can be installed in the dwelling opening, and then the shade body 20 fastened to the head rail member 40 employing the hook and loop tape strips 46. In addition a grommet 38*c* is positioned at each top corner of the shade body 20 (FIG. 1) to accommodate fasteners inserted into the head rail member 40 to further secure the shade body 20 thereto.

Figure 2:
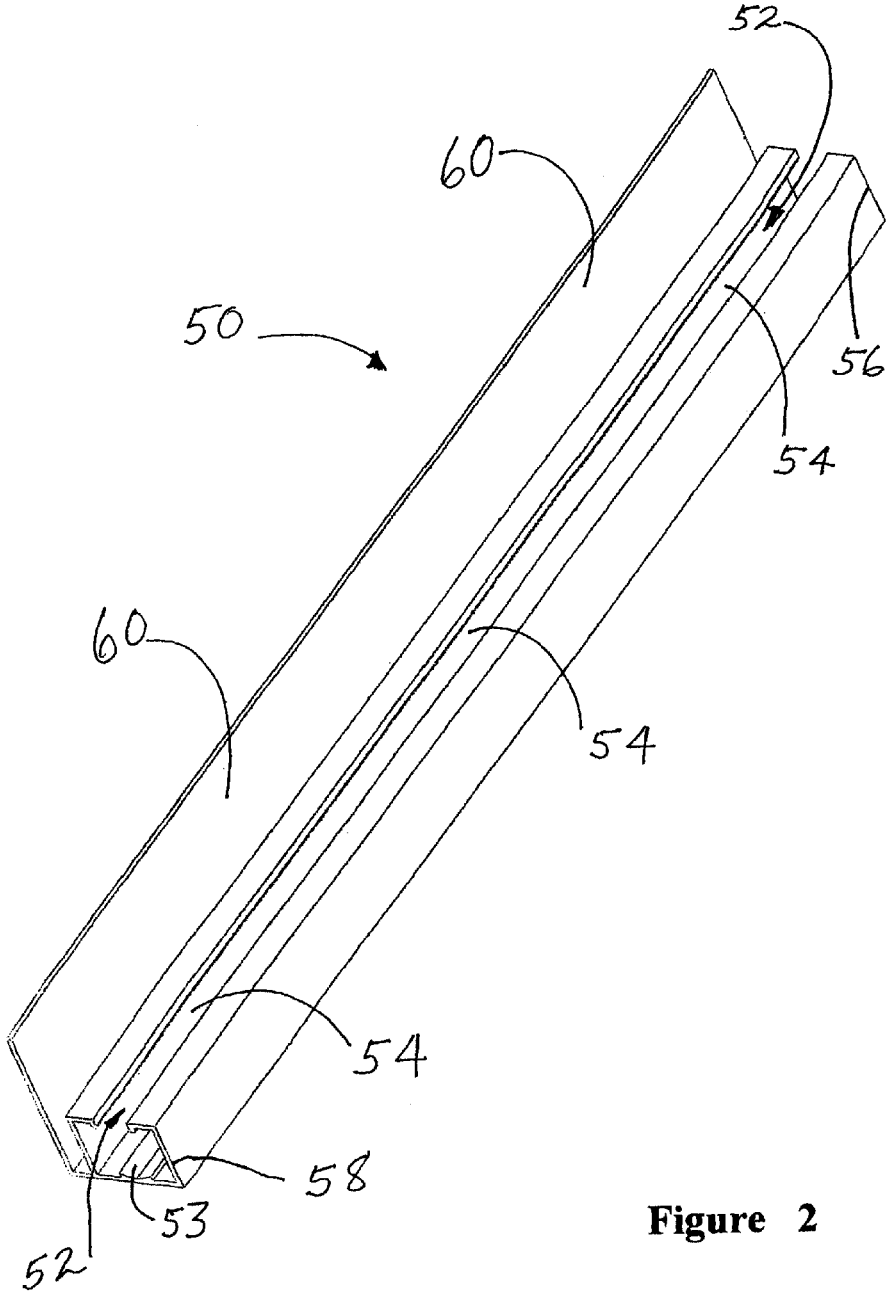
FIG. 2 is a perspective view of one of the track members of the roman shade assembly of the present invention.
Figure 3:
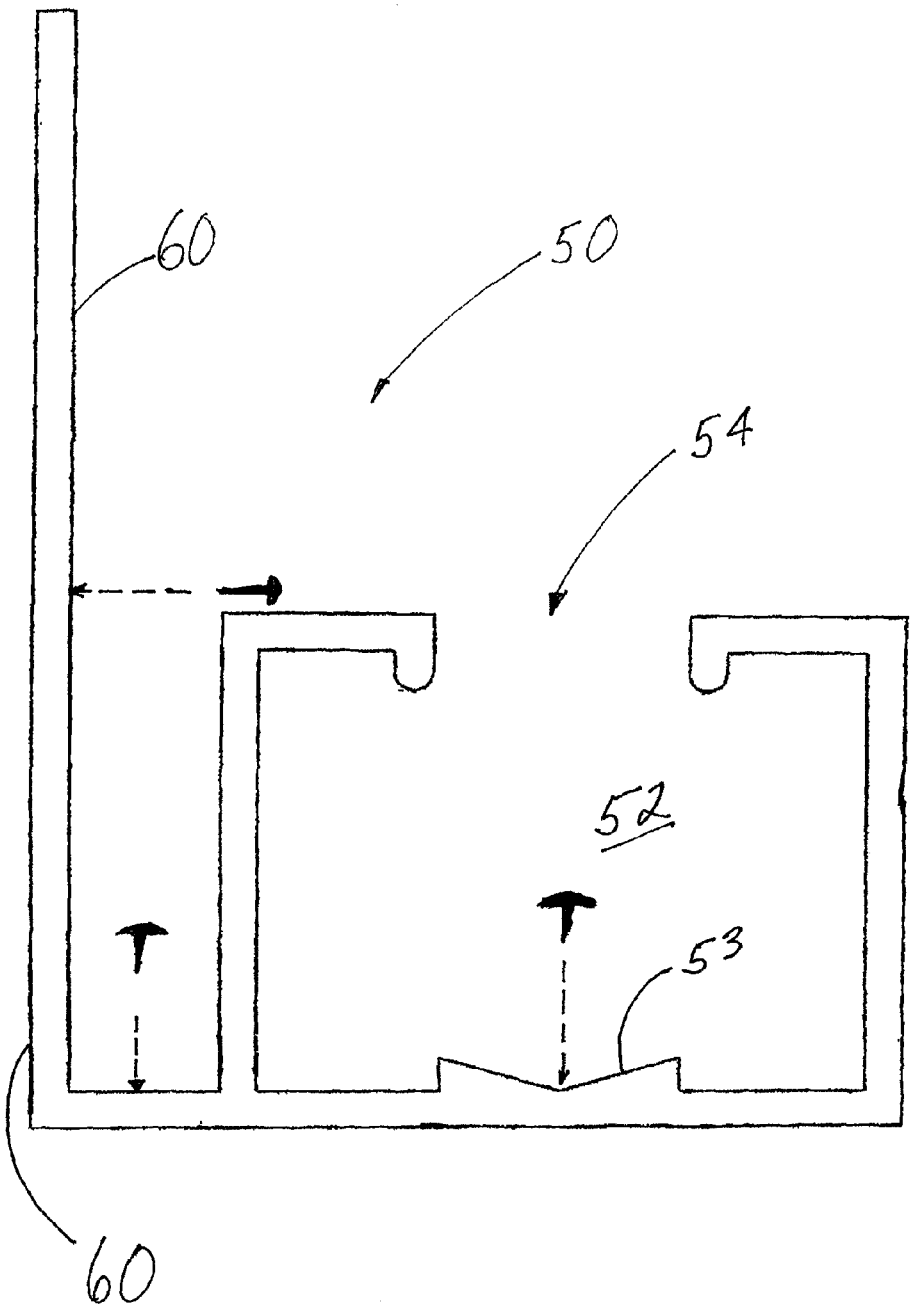
FIG. 3 is a sectional view of the track member of the roman shade assembly of the present invention.

Referring now also to FIGS. 2 and 3, a pair of linear track members 50 are adapted for mounting vertically on opposite sides of the dwelling opening. Each linear track member 50 includes a hollow interior 52 with an access slot 54 that extends between the first open end 56 and the second open end 58 of the track member 50. Each linear track member 50 has an exterior mounting flange 60 that also extends between the first and second ends 56, 58 of the track member 50. The mounting flanges 60 are secured to the casing of the dwelling opening to secure each liner track member 50 thereto. The mounting flange 60 also functions a wind stop, as described below. Alternatively, the linear track member 50 is secured to the casing of the dwelling opening by fasteners penetrating the linear track member 50 from the hollow interior 52 thereof, as illustrated in FIG. 3. The shade body 20 is sized to fit between the vertically mounted track members 50, and each pocket 32 of the shade body 20 includes a rigid rod member 36 providing horizontal rigidity to the shade body 20. Preferably, the rod members 36 are fabricated from stainless steel for corrosion resistance. In a further embodiment, the rigid rod member 36 positioned within the pocket 32 at the bottom edge 24 of the shade body 20 (FIG. 1) is flattened for the purpose outlined below.

Figure 4:
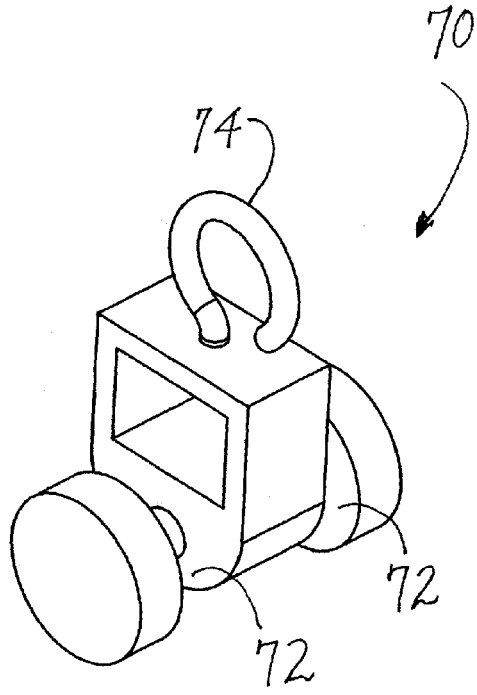
FIG. 4 is a perspective view of one of the wheeled clip members of the roman shade assembly of the present invention.

Referring now to FIG. 4, a plurality of wheeled clip members 70 are movably maintained within each linear track member 50. Each wheeled clip member 70 within each linear track member 50 includes a wheeled portion 72 maintained within the hollow interior 52 of the track member 50, and a clip portion 74 extending through the access slot 54 therein. Preferably the wheel portion includes a pair of wheels 76 on a single axle with the clip portion 74 secured to the axle and extending between the pair of wheels 76. A cross section of one linear track member 50 is shown in FIG. 3. The hollow interior 52 of the track member 50 includes an elevated strip 53 opposite the access slot 54 extending the full length of the track member 50. In addition, a retaining clip member 86 is movably secured within each open end of the linear track member 50 to retain the wheeled clip members 70 there within. The elevated strip 53 maintains the alignment of the pair of wheels 74 within the linear track member 50. Each pocket 32 of the shade body 20 has a grommet 38 positioned adjacent each side edge 26, 28 of the shade body 20. Each wheeled clip member 70 is attached to one side edge 26, 28 of the shade body 20 by the clip portion 74 of the wheeled clip member 70 engaging an edge grommet 38, thereby maintaining the side edges 26, 28 of the shade body 20 in close proximity to the track members 50, which are secured on opposite sides of the dwelling opening.

A plurality of draw string members 80 each are attached to the bottom edge 24 of the shade body 20, preferably on the side of the shade body 20 having the pockets 32. The pockets 32 of the shade body 20 include corresponding columns of vertically aligned grommets 38*a* offset from the edges 26, 28 of the shade body 20. The unattached end of each draw string member 80 is threaded through a column of vertically aligned grommets 38*a* in the pockets 32 of the shade body 20. The draw string members 80 are then threaded through the pulley members 42 attached to the head rail member 40. Preferably, the pulley members 42 are hanging swivel pulleys, with a shroud that guides the draw string members 80 up and over the wheel of the pulley members 42. The draw string members 80 are adapted for extending interior the dwelling, thereby providing raising or lowering of the shade body 20 from within the dwelling. The flattened, rigid rod member 36 of the pocket 32 of the bottom edge 24 of the shade body 20 carries all the weight of the shade body 20 and attached wheeled clip members 70 during raising and lower of the shade body 20. Location of all of the grommets 38*a*, 38*b* in the pockets 32 of the shade body 20 provides for one smooth surface of the shade body 20, which is positioned opposite the dwelling opening covered by the shade body 20.

Figure 7:
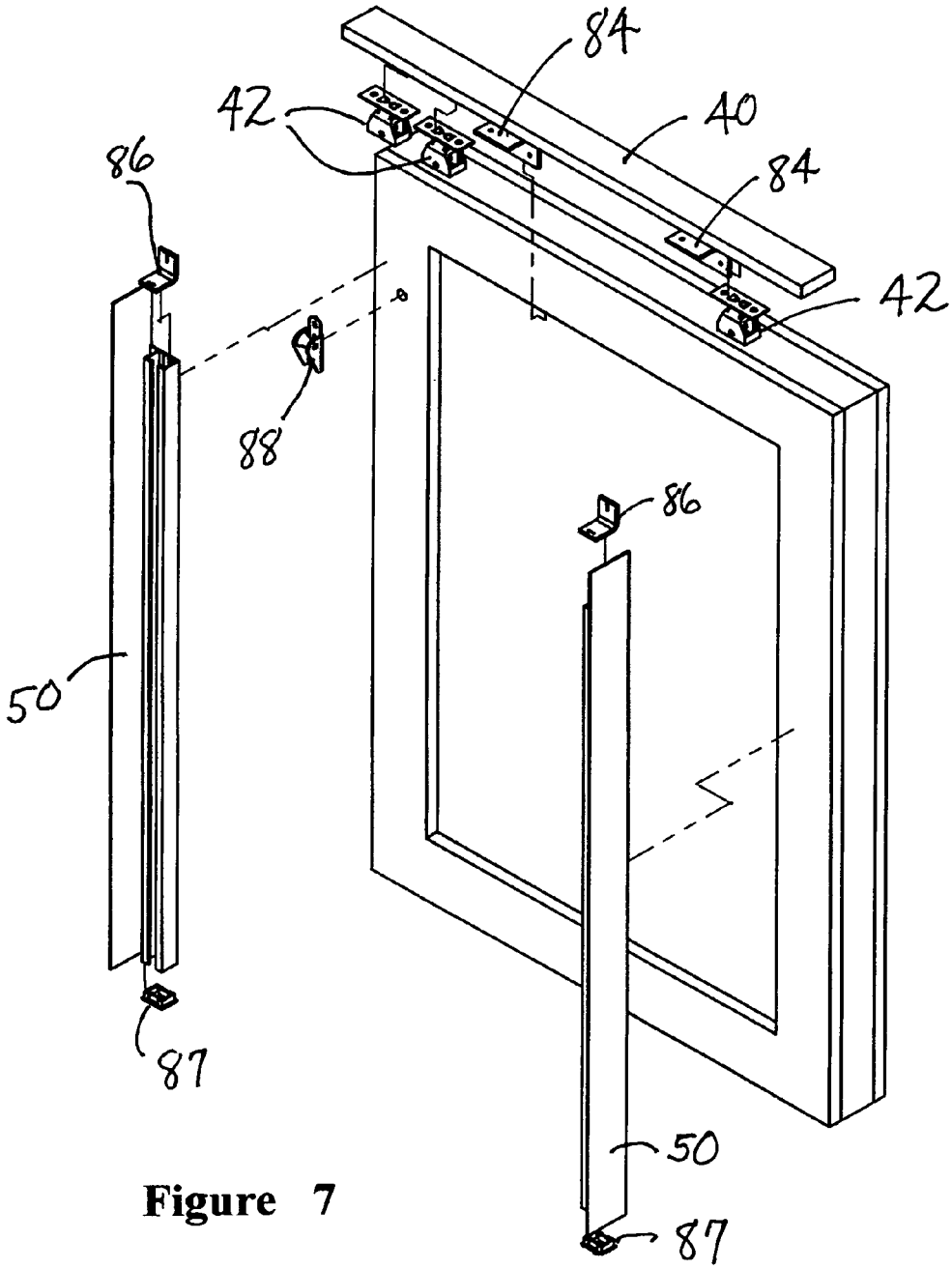
FIG. 7 is an exploded, perspective view of the head rail and track members of the roman shade assembly of the present invention fitted to the exterior of a dwelling window.
Figure 8:
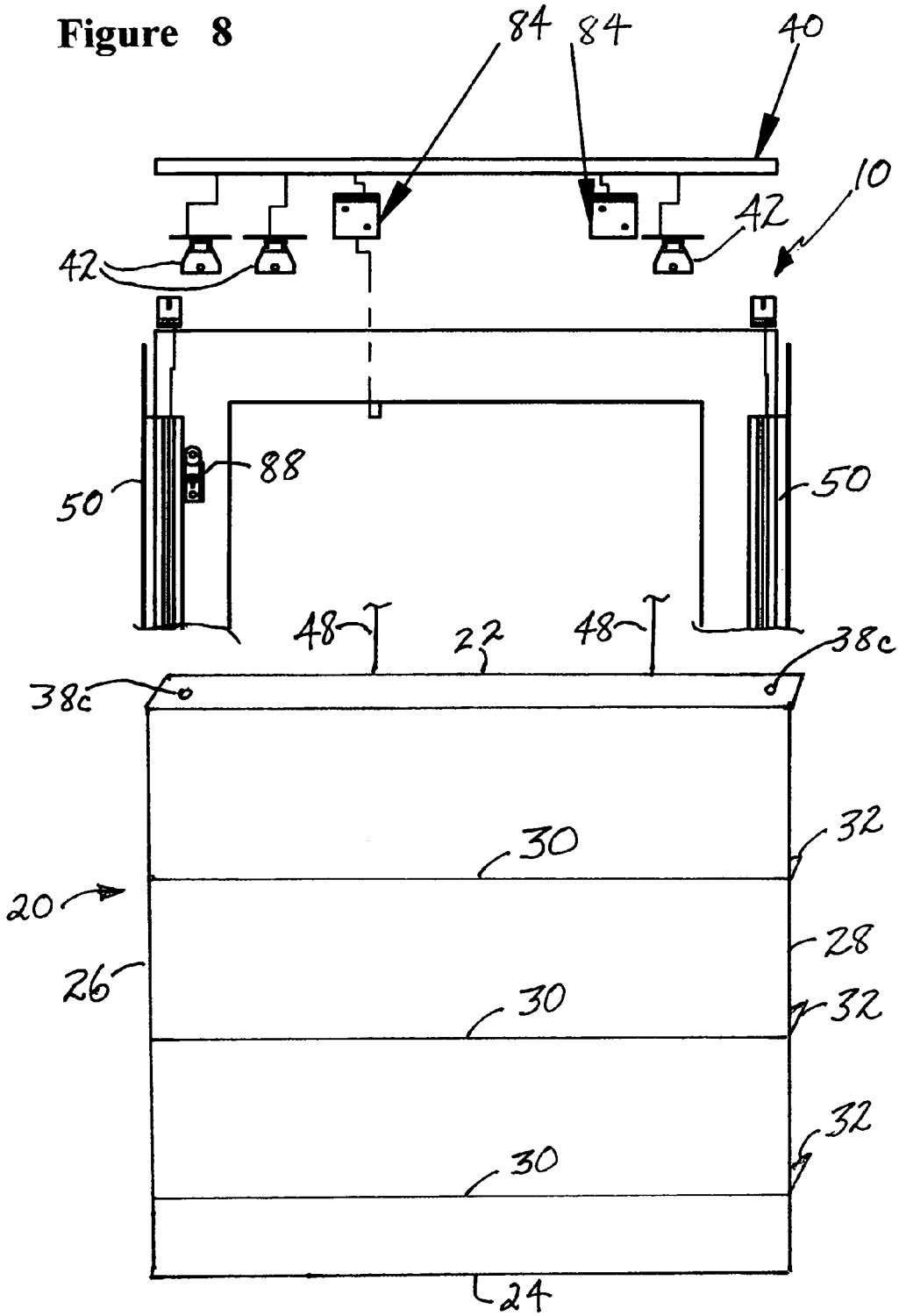
FIG. 8 is an exploded, perspective view of the head rail, track members and shade body of the roman shade assembly of the present invention fitted to the exterior of a dwelling window.
Figure 9A:
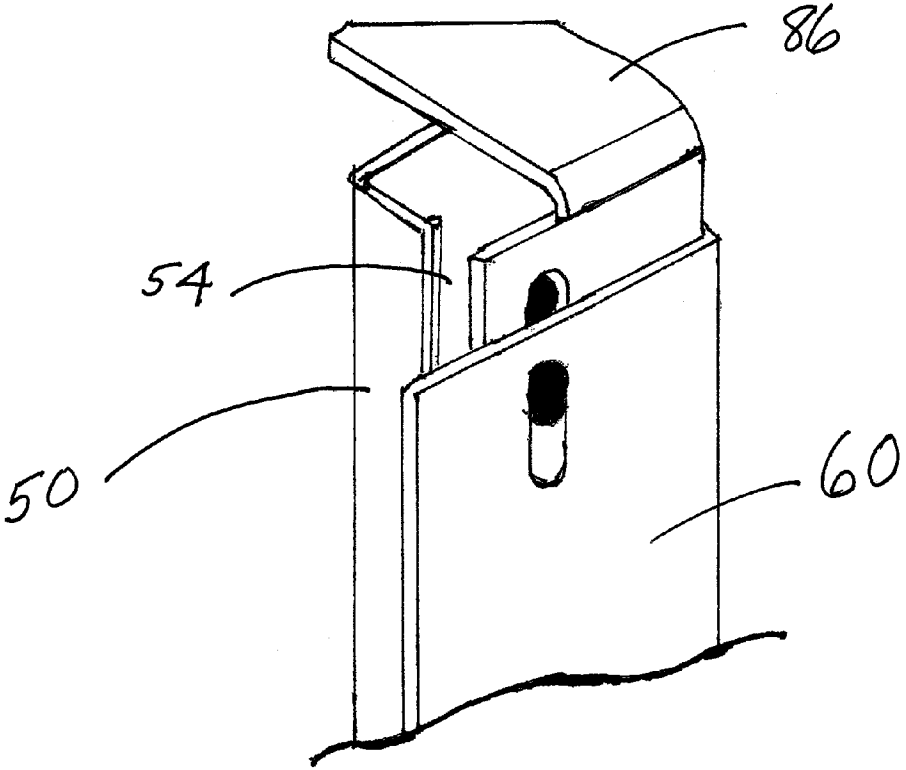
FIG. 9*a* is a perspective view of a track stop member of the roman shade assembly of the present invention in an open condition.
Figure 9B:
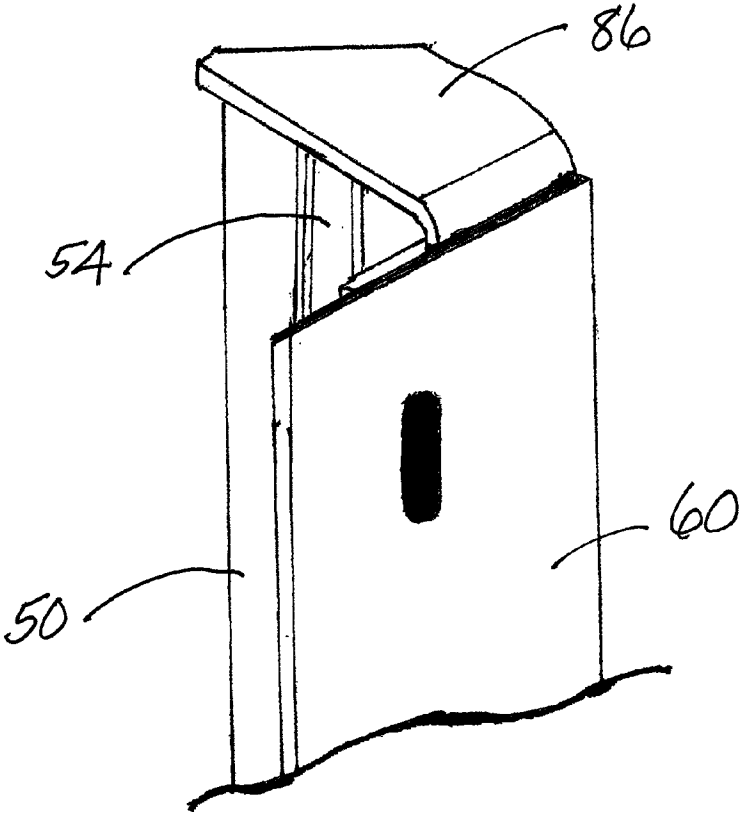
FIG. 9*b* is a perspective view of a track stop member of the roman shade assembly of the present invention in a closed condition.

As indicated above, preferably the head rail member 40 and linear track members 50 are secured to the casing of the dwelling opening. Alternatively, the head rail member 40 and linear track members 50 are secured to the exterior wall of the dwelling surrounding the dwelling opening. In this installation, the shade body member 20 and head rail member 40 are sufficiently sized to cover both the dwelling opening and the surrounding casing or exterior molding. The draw string members 80 can also be routed directly through the exterior wall to the interior of the dwelling, thereby providing raising or lowering of the shade body 20 from within the dwelling. Exploded views of the roman shade assembly 10 installed on the interior of a dwelling opening are shown in FIGS. 5 and 6, while similar views of the roman shade assembly 10 installed on the exterior a dwelling opening are shown in FIGS. 7 and 8.

While the invention has been particularly shown and described with reference to preferred embodiments thereof, it will be understood by those skilled in the art that various changes in form and details may be made therein without departing from the spirit and scope of the invention.

I claim:

1. A roman shade assembly adapted for vertical movement to provide an opaque covering for a dwelling opening, the roman shade assembly comprising:

a planar shade body of flexible material including a top edge and a bottom edge with a plurality of horizontal pleats and pockets extending between opposed side edges of the shade body;

a head rail member adapted for installation at a top of a dwelling opening, the head rail member including a plurality of pulleys and an attachment system for securing the top edge of the shade body to the head rail member;

a pair of linear track members adapted for mounting vertically on opposite sides of the dwelling opening, each linear track member including a hollow interior with an access slot extending the length of the track member between first and second open ends thereof, each linear track member including an L-shaped exterior mounting flange extending the length of the track member between first and second ends thereof; the L-shaped mounting flange having a first leg portion intersecting and fastened along the length of the track member, and a second leg portion extending from the first leg portion parallel to and beyond the track member, the second leg portion providing an unobstructed surface adapted for fastening the linear track member to the casing of the dwelling opening;

the shade body sized to fit between said vertically mounted track members, each pocket of the shade body including a rigid rod member providing horizontal rigidity to the shade body;

a plurality of wheeled clip members movably maintained within each linear track member, each wheeled clip member attached to one side edge of the shade body by a clip portion for maintaining the shade body close to the track members; and a plurality of draw string members each attached to the bottom edge of the shade body and threaded through vertically aligned grommets in the shade body, the draw string members threaded through the pulleys attached to the head rail member, the draw string members adapted for extending interior the dwelling, thereby providing raising or lowering of the shade body from within the dwelling.

2. The roman shade assembly of claim 1, wherein the attachment system for securing the top edge of the shade body to the head rail member includes a length of hook and loop tape strip fastened to each of the top edge of the shade body and the head rail member.

3. The roman shade assembly of claim 1, wherein the wheeled clip member within each linear track member includes a wheeled portion maintained within the hollow interior of the track member with a clip portion extending through the access slot therein and attached to one side edge of the shade body.

4. The roman shade assembly of claim 1, wherein the pockets of the shade body are positioned on a single surface of the shade body.

5. The roman shade assembly of claim 1, wherein the shade body includes a plurality of attachment grommets positioned at regular intervals along each side edge thereof, with the clip portion of each wheeled clip member secured to an attachment grommet.

6. The roman shade assembly of claim 5, wherein the each attachment grommet is positioned on a pocket of the shade body member.

7. The roman shade assembly of claim 1, wherein the shade body includes a plurality of vertically aligned draw string grommets positioned at regular intervals, the vertically aligned draw string grommets offset from the opposed side edges of the shade body.

8. The roman shade assembly of claim 7, wherein each draw string grommet is positioned on a pocket of the shade body member.

9. A roman shade assembly adapted for vertical movement to provide an opaque covering for a dwelling opening, the roman shade assembly comprising:

a planar shade body of flexible material including a top edge and a bottom edge with a plurality of horizontal pleats and pockets extending between opposed side edges of the shade body, the pockets of the shade body positioned on a single surface thereof;

a head rail member adapted for installation at a top of a dwelling opening, the head rail member including a plurality of pulleys and an attachment system for securing the top edge of the shade body to the head rail member;

a pair of linear track members adapted for mounting vertically on opposite sides of the dwelling opening, each linear track member including a hollow interior with an access slot extending the length of the track member between first and second open ends thereof, each linear track member including an L-shaped exterior mounting flange extending the length of the track member between first and second ends thereof; the L-shaped mounting flange having a first leg portion intersecting and fastened along the length of the track member, and a second leg portion extending from the first leg portion parallel to and beyond the track member, the second leg portion providing an unobstructed surface adapted for fastening the linear track member to the casing of the dwelling opening;

the shade body sized to fit between said vertically mounted track members, each pocket of the shade body including a rigid rod member providing horizontal rigidity to the shade body;

a plurality of wheeled clip members movably maintained within each linear track member, each wheeled clip member attached to one side edge of the shade body for maintaining the shade body close to the track members; and a plurality of draw string members each attached to the bottom edge of the shade body and threaded through vertically aligned grommets in the shade body, the draw string members threaded through the pulleys attached to the head rail member, the draw string members adapted for extending interior the dwelling, thereby providing raising or lowering of the shade body from within the dwelling.

10. The roman shade assembly of claim 9, wherein the attachment system for securing the top edge of the shade body to the head rail member includes a length of hook and loop tape strip fastened to each of the top edge of the shade body and the head rail member.

11. The roman shade assembly of claim 9, wherein the wheeled clip member within each linear track member includes a wheeled portion maintained within the hollow interior of the track member with a clip portion extending through the access slot therein and attached to one side edge of the shade body.

12. The roman shade assembly of claim 9, wherein the shade body includes a plurality of attachment grommets positioned at regular intervals along each side edge thereof, with the clip portion of each wheeled clip member secured to an attachment grommet.

13. The roman shade assembly of claim 9, wherein the shade body includes a plurality of vertically aligned draw string grommets positioned at regular intervals, the vertically aligned draw string grommets offset from the opposed side edges of the shade body.

14. The roman shade assembly of claim 12, wherein the attachment grommets of the shade body are each positioned on a pocket thereof.

15. The roman shade assembly of claim 13, wherein each draw string grommet of the shade body are positioned on a pocket thereof.

16. A roman shade assembly adapted for vertical movement to provide an opaque covering for a dwelling opening, the roman shade assembly comprising:

a planar shade body of flexible material including a top edge and bottom edge with a plurality of horizontal pleats and pockets extending between opposed side edges of the shade body, the pockets of the shade body positioned on a single surface thereof;

a head rail member adapted for installation at a top of a dwelling opening, the head rail member including a plurality of pulleys and an attachment system for securing the top edge of the shade body to the head rail member, the attachment system including a length of hook and loop tape strip fastened to each of the top edge of the shade body and the head rail member;

a pair of linear track members adapted for mounting vertically on opposite sides of the dwelling opening, each linear track member including a hollow interior with an access slot extending the length of the track member between first and second open ends thereof, each linear track member including an L-shaped exterior mounting flange extending the length of the track member between first and second ends thereof; the L-shaped mounting flange having a first leg portion intersecting and fastened along the length of the track member, and a second leg portion extending from the first leg portion parallel to and beyond the track member, the second leg portion providing an unobstructed surface adapted for fastening the linear track member to the casing of the dwelling opening;

the shade body sized to fit between said vertically mounted track members, each pocket of the shade body including a rigid rod member providing horizontal rigidity to the shade body;

a plurality of wheeled clip members movably maintained within each linear track member, each wheeled clip member including a wheeled portion maintained within the hollow interior of the track member with a clip portion extending through the access slot therein and attached to one side edge of the shade body by the clip portion for maintaining the shade body close to the track members; and a plurality of draw string members each attached to the bottom edge of the shade body and threaded through vertically aligned grommets in the shade body, the draw string members threaded through the pulleys attached to the head rail member, the draw string members adapted for extending interior the dwelling, thereby providing raising or lowering of the shade body from within the dwelling.

17. The roman shade assembly of claim 16, wherein the shade body includes a plurality of attachment grommets positioned at regular intervals along each side edge thereof, with the clip portion of each wheeled clip member secured to an attachment grommet.

18. The roman shade assembly of claim 16, wherein the shade body includes a plurality of vertically aligned draw string grommets positioned at regular intervals, the vertically aligned draw string grommets offset from the opposed side edges of the shade body.

* * * * *